US008058571B2

(12) United States Patent
Rajagopal et al.

(10) Patent No.: US 8,058,571 B2
(45) Date of Patent: Nov. 15, 2011

(54) DUAL-ACTION SINGLE-KEY MECHANISM

(75) Inventors: Vijai Rajagopal, Waterloo (CA); Firmansyah Sulem, Waterloo (CA); Timothy Kyowski, Waterloo (CA); James Infanti, Waterloo (CA)

(73) Assignee: Research In Motion Limited, Waterloo (CA)

( * ) Notice: Subject to any disclaimer, the term of this patent is extended or adjusted under 35 U.S.C. 154(b) by 341 days.

(21) Appl. No.: 12/392,324

(22) Filed: Feb. 25, 2009

(65) Prior Publication Data

US 2010/0084251 A1 Apr. 8, 2010

Related U.S. Application Data

(60) Provisional application No. 61/103,789, filed on Oct. 8, 2008.

(51) Int. Cl.
*H01H 9/00* (2006.01)

(52) U.S. Cl. ..... 200/1 B; 200/341; 200/296

(58) Field of Classification Search ..... 200/1 B, 200/511–517, 5 R, 341, 296
See application file for complete search history.

(56) References Cited

U.S. PATENT DOCUMENTS

| | | | | |
|---|---|---|---|---|
| 4,668,843 | A * | 5/1987 | Watanabe et al. | 200/5 A |
| 5,350,890 | A * | 9/1994 | Fairbrother et al. | 200/5 A |
| 5,510,584 | A | 4/1996 | Norris | |
| 5,717,176 | A * | 2/1998 | Dahlstrom | 200/1 B |
| 5,924,557 | A * | 7/1999 | Pollock | 200/534 |
| 5,952,629 | A * | 9/1999 | Yoshinaga et al. | 200/5 A |
| 6,166,662 | A * | 12/2000 | Chuang | 341/22 |
| 6,303,887 | B1 * | 10/2001 | Ando | 200/512 |
| 6,492,602 | B2 * | 12/2002 | Asai et al. | 200/1 B |
| 6,880,989 | B2 | 4/2005 | Sotome | |
| 6,995,324 | B2 | 2/2006 | Asada | |
| 7,157,650 | B2 | 1/2007 | Rochon | |
| 7,217,893 | B1 * | 5/2007 | Huang et al. | 200/1 B |
| 2008/0053807 | A1 | 3/2008 | Chou | |
| 2008/0122945 | A1 | 5/2008 | Ahonen | |
| 2008/0138061 | A1 | 6/2008 | Saiki | |

FOREIGN PATENT DOCUMENTS

| | | | |
|---|---|---|---|
| DE | 10047998 | A1 | 3/2001 |
| WO | WO 98/02894 | A1 | 1/1998 |

OTHER PUBLICATIONS

Ruppert, Christopher; Search Report from corresponding European Application No. 09153637.5; completed May 12, 2009, received by applicant Jun. 14, 2009.

* cited by examiner

*Primary Examiner* — Michael Friedhofer
(74) *Attorney, Agent, or Firm* — Blake, Cassels & Graydon LLP; Wilfred P. So; Brett J. Slaney

(57) ABSTRACT

A switch assembly is provided to actuate a pair of switches using a single key cap, e.g. for a camera that utilizes a first switch to activate an image focusing function and a second switch to activate a camera shutter. The switch assembly comprises an inner switch and an outer switch, wherein the outer switch partially or completely surrounds the perimeter of the inner switch. The outer switch comprises an upper conductive surface and a lower conductive surface that, when in contact, electrically couples two terminals for closing a circuit. The inner switch comprises an actuator and a dome switch. When the key cap receives a first downward force, only the outer switch becomes activated and a first electric circuit is completed. When the key cap receives a second downward force that is greater than the first force, the dome switch collapses and a second electric circuit is completed.

20 Claims, 14 Drawing Sheets

DUAL-ACTION SINGLE-KEY MECHANISM

This application claims priority from U.S. Application No. 61/103,789, filed on Oct. 8, 2008 the contents of which are incorporated herein by reference.

TECHNICAL FIELD

The following relates generally to switches, and more particularly to two-stage electrical switches.

DESCRIPTION OF THE RELATED ART

In electronic devices, such as digital camera devices, there may be different functions corresponding to various keys with which the user interacts. For example, in a camera, one key may allow the user to control the on/off functionality, while an ancillary key controls the camera shutter. As the number of functions of electronic devices increases, it is expected that the number of user control keys would also increase, which can lead to over crowding of keys and increased user interface complexity.

There are various switch devices that combine two separate switches into a single key. For example, a camera may provide the focusing function and the camera shutter function in a single two-stage switch under control of a common push button. Such devices operate by receiving a first downward force on a switch device to activate the focusing function. After the camera has focused, if the device receives a second downward force greater than the first downward force, the camera shutter function is then activated, thereby capturing an image.

The above devices often utilize a single push button with an actuator protruding from the key to depress a dual action dome switch to first activate the auto-focus, and then the camera shutter. For improved performance, the actuator should be aligned with the dome switch, which can be difficult to control without adding complexity to the device.

When implementing two-stage electrical switches, there may also be difficulty in discerning between the different stage activations through tactile feedback.

BRIEF DESCRIPTION OF THE DRAWINGS

Embodiments will now be described by way of example only with reference to the appended drawings wherein.

DETAILED DESCRIPTION

Figure 2:
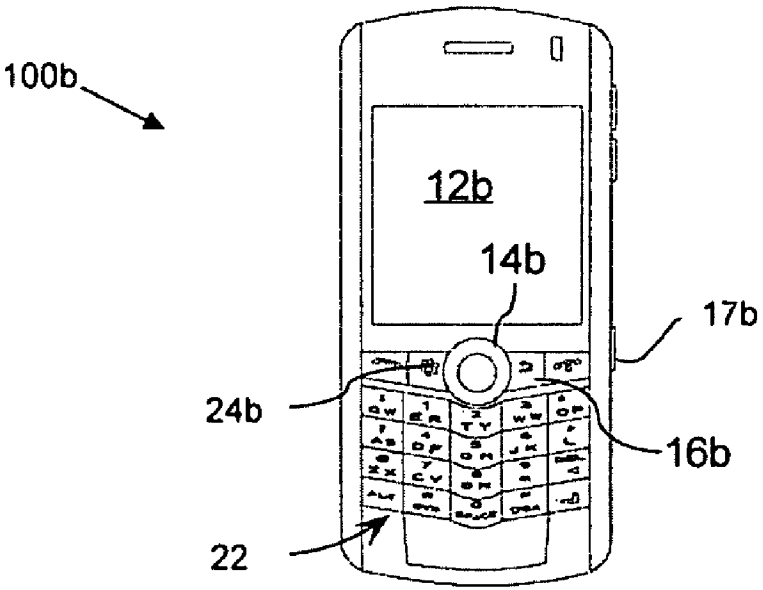
FIG. 2 is a plan view of another mobile device and a display screen therefor.

It will be appreciated that for simplicity and clarity of illustration, where considered appropriate, reference numerals may be repeated among the figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

In the field of electronic devices, push keys may be used to activate functions within the device. The operation of input devices, for example push keys may depend on the type of electronic device and the applications of the device.

Examples of applicable electronic devices include pagers, cellular phones, cellular smart-phones, wireless organizers, personal digital assistants, computers, laptops, handheld wireless communication devices, wirelessly enabled notebook computers, camera devices and the like. Such devices will hereinafter be commonly referred to as "mobile devices" for the sake of clarity. It will however be appreciated that the principles described herein are also suitable to other devices, e.g. "non-mobile" devices.

In an embodiment, the mobile device is a two-way communication device with advanced data communication capabilities including the capability to communicate with other mobile devices or computer systems through a network of transceiver stations. The mobile device may also have the capability to allow voice communication. Depending on the functionality provided by the mobile device, it may be referred to as a data messaging device, a two-way pager, a cellular telephone with data messaging capabilities, a wireless Internet appliance, or a data communication device (with or without telephony capabilities).

Figure 1:
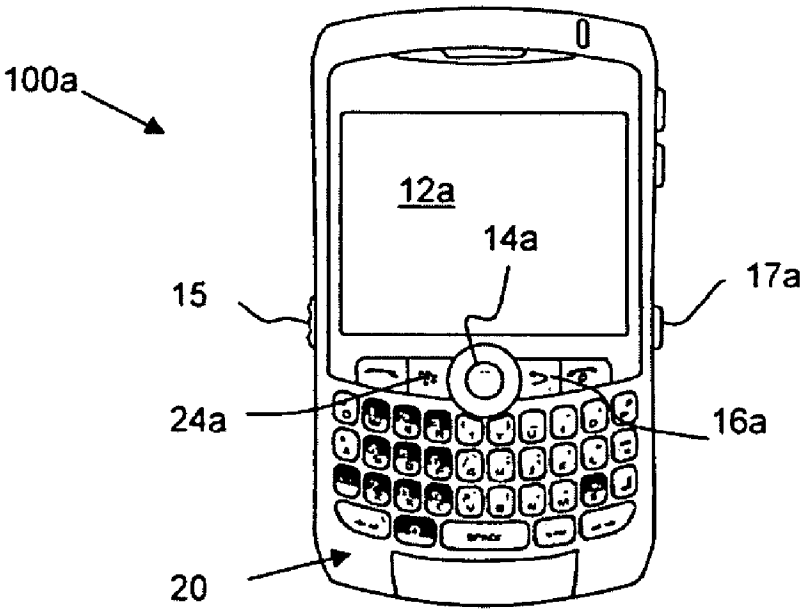
FIG. 1 is a plan view of a mobile device and a display screen therefor.

Referring to FIGS. 1 and 2, one embodiment of a mobile device 100*a* is shown in FIG. 1, and another embodiment of a mobile device 100*b* is shown in FIG. 2. It will be appreciated that the numeral "100" will hereinafter refer to any mobile device 100, including the embodiments 100*a* and 100*b*, those embodiments enumerated above or otherwise. It will also be appreciated that a similar numbering convention may be used for other general features common between FIGS. 1 and 2 such as a display 12, a positioning device 14, a cancel or escape button 16, a camera button 17, and a menu or option button 24.

The mobile device 100*a* shown in FIG. 1 comprises a display 12*a* and the cursor or view positioning device 14 shown in this embodiment is a trackball 14*a*. Positioning device 14 may serve as another input member and is both rotational to provide selection inputs to the main processor 102 (see FIG. 3) and can also be pressed in a direction generally towards the housing to provide another selection input to the processor 102. Trackball 14*a* permits multi-directional positioning of the selection cursor 18 (see FIG. 5) such that the selection cursor 18 can be moved in an upward direction, in a downward direction and, if desired and/or permitted, in any diagonal direction. The trackball 14*a* is in this example situated on the front face of a housing for mobile device 100*a* as shown in FIG. 1 to enable a user to maneuver the trackball 14*a* while holding the mobile device 100*a* in one hand. The trackball 14*a* may serve as another input member (in addition to a directional or positioning member) to provide selection inputs to the processor 102 and can preferably be pressed in a direction towards the housing of the mobile device 100*b* to provide such a selection input.

The display 12 may include a selection cursor 18 that depicts generally where the next input or selection will be received. The selection cursor 18 may comprise a box, alteration of an icon or any combination of features that enable the user to identify the currently chosen icon or item. The mobile device 100*a* in FIG. 1 also comprises a programmable convenience button 15 to activate a selected application such as, for example, a calendar or calculator. Further, mobile device 100*a* includes an escape or cancel button 16*a*, a camera button 17*a*, a menu or option button 24*a* and a keyboard 20. The camera button 17 is able to activate photo-capturing functions when pressed preferably in the direction towards the housing. The menu or option button 24 loads a menu or list of options on display 12*a* when pressed. In this example, the escape or cancel button 16*a*, the menu option button 24*a*, and keyboard 20 are disposed on the front face of the mobile device housing, while the convenience button 15 and camera button 17*a* are disposed at the side of the housing. This button placement enables a user to operate these buttons while holding the mobile device 100 in one hand. The keyboard 20 is, in this embodiment, a standard QWERTY keyboard.

The mobile device 100*b* shown in FIG. 2 comprises a display 12*b* and the positioning device 14 in this embodiment is a trackball 14*b*. The mobile device 100*b* also comprises a menu or option button 24*b*, a cancel or escape button 16*b*, and a camera button 17*b*. The mobile device 100*b* as illustrated in FIG. 2, comprises a reduced QWERTY keyboard 22. In this embodiment, the keyboard 22, positioning device 14*b*, escape button 16*b* and menu button 24*b* are disposed on a front face of a mobile device housing. The reduced QWERTY keyboard 22 comprises a plurality of multi-functional keys and corresponding indica including keys associated with alphabetic characters corresponding to a QWERTY array of letters A to Z and an overlaid numeric phone key arrangement.

It will be appreciated that for the mobile device 100, a wide range of one or more positioning or cursor/view positioning mechanisms such as a touch pad, a positioning wheel, a joystick button, a mouse, a touchscreen, a set of arrow keys, a tablet, an accelerometer (for sensing orientation and/or movements of the mobile device 100 etc.), or other whether presently known or unknown may be employed. Similarly, any variation of keyboard 20, 22 may be used. It will also be appreciated that the mobile devices 100 shown in FIGS. 1 and 2 are for illustrative purposes only and various other mobile devices 100 are equally applicable to the following examples. For example, other mobile devices 100 may include the trackball 14*b*, escape button 16*b* and menu or option button 24 similar to that shown in FIG. 2 only with a full or standard keyboard of any type. Other buttons may also be disposed on the mobile device housing such as color coded "Answer" and "Ignore" buttons to be used in telephonic communications. In another example, the display 12 may itself be touch sensitive thus itself providing an input mechanism in addition to display capabilities.

To aid the reader in understanding the structure of the mobile device 100, reference will now be made to FIGS. 3 through 6.

Figure 3:
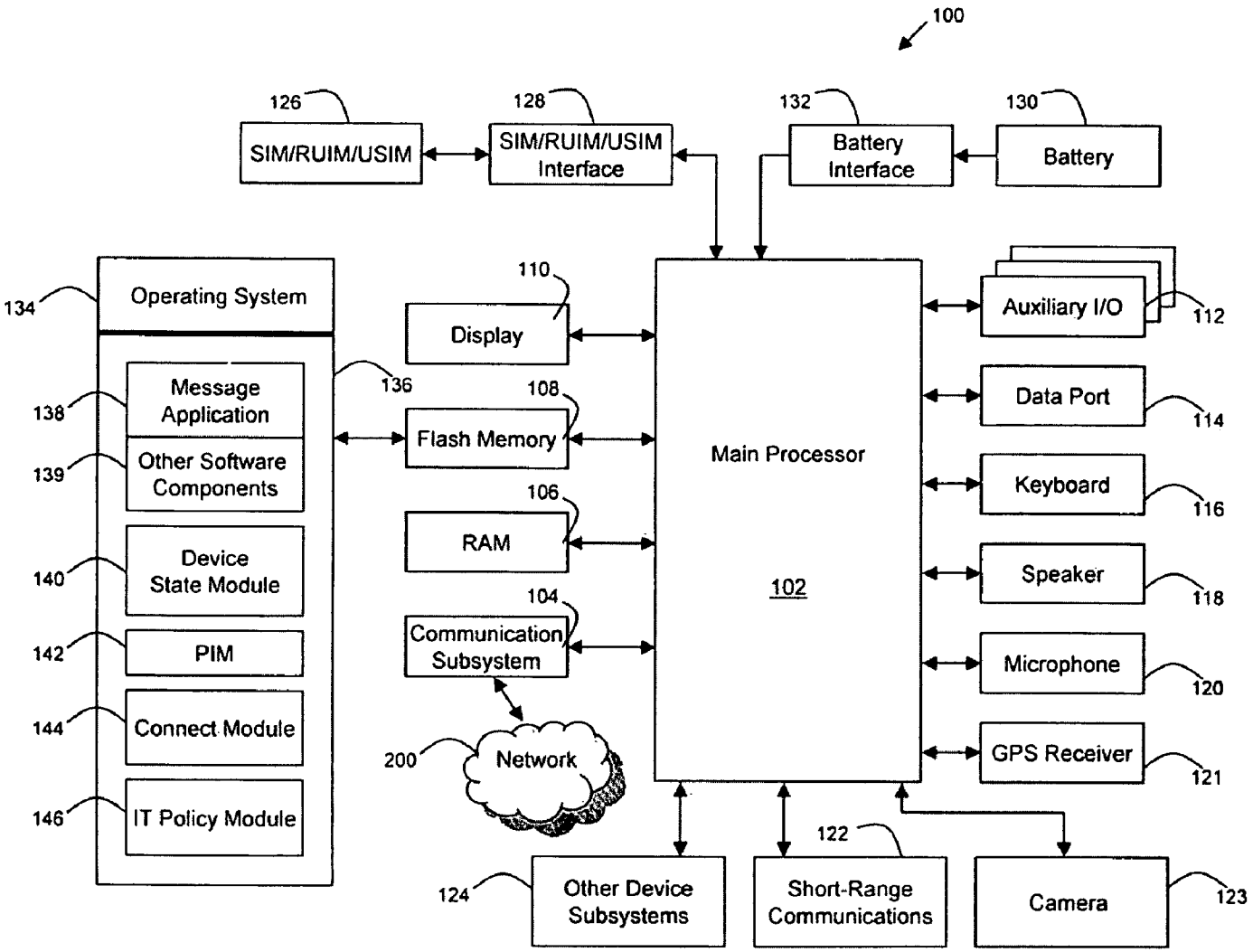
FIG. 3 is a block diagram of an exemplary embodiment of a mobile device.

Referring first to FIG. 3, shown therein is a block diagram of an exemplary embodiment of a mobile device 100. The mobile device 100 comprises a number of components such as a main processor 102 that controls the overall operation of the mobile device 100. Communication functions, including data and voice communications, are performed through a communication subsystem 104. The communication subsystem 104 receives messages from and sends messages to a wireless network 200. In this exemplary embodiment of the mobile device 100, the communication subsystem 104 is configured in accordance with the Global System for Mobile Communication (GSM) and General Packet Radio Services (GPRS) standards, which is used worldwide. Other communication configurations that are equally applicable are the 6G and 4G networks such as EDGE, UMTS and HSDPA, LTE, Wi-Max etc. New standards are still being defined, but it is believed that they will have similarities to the network behaviour described herein, and it will also be understood by persons skilled in the art that the embodiments described herein are intended to use any other suitable standards that are developed in the future. The wireless link connecting the communication subsystem 104 with the wireless network 200 represents one or more different Radio Frequency (RF) channels, operating according to defined protocols specified for GSM/GPRS communications.

The main processor 102 also interacts with additional subsystems such as a Random Access Memory (RAM) 106, a flash memory 108, a display 110, an auxiliary input/output (I/O) subsystem 112, a data port 114, a keyboard 116, a speaker 118, a microphone 120, a GPS receiver 121, short-range communications 122, a camera 123 and other device subsystems 124.

Some of the subsystems of the mobile device 100 perform communication-related functions, whereas other subsystems may provide "resident" or on-device functions. By way of example, the display 110 and the keyboard 116 may be used for both communication-related functions, such as entering a text message for transmission over the network 200, and device-resident functions such as a calculator or task list.

The mobile device 100 can send and receive communication signals over the wireless network 200 after required network registration or activation procedures have been completed. Network access is associated with a subscriber or user of the mobile device 100. To identify a subscriber, the mobile device 100 may use a subscriber module component or "smart card" 126, such as a Subscriber Identity Module (SIM), a Removable User Identity Module (RUIM) and a Universal Subscriber Identity Module (USIM). In the example shown, a SIM/RUIM/USIM 126 is to be inserted into a SIM/RUIM/USIM interface 128 in order to communicate with a network. Without the component 126, the mobile device 100 is not fully operational for communication with the wireless network 200. Once the SIM/RUIM/USIM 126 is inserted into the SIM/RUIM/USIM interface 128, it is coupled to the main processor 102.

The mobile device 100 is a battery-powered device and includes a battery interface 132 for receiving-one or more rechargeable batteries 130. In at least some embodiments, the battery 130 can be a smart battery with an embedded microprocessor. The battery interface 132 is coupled to a regulator (not shown), which assists the battery 130 in providing power V+ to the mobile device 100. Although current technology makes use of a battery, future technologies such as micro fuel cells may provide the power to the mobile device 100.

The mobile device 100 also includes an operating system 134 and software components 136 to 146 which are described in more detail below. The operating system 134 and the software components 136 to 146 that are executed by the main processor 102 are typically stored in a persistent store such as the flash memory 108, which may alternatively be a read-only memory (ROM) or similar storage element (not shown). Those skilled in the art will appreciate that portions of the operating system 134 and the software components 136 to 146, such as specific device applications, or parts thereof, may be temporarily loaded into a volatile store such as the RAM 106. Other software components can also be included, as is well known to those skilled in the art.

The subset of software applications 136 that control basic device operations, including data and voice communication applications, may be installed on the mobile device 100 during its manufacture. Software applications may include a message application 138, a device state module 140, a Personal Information Manager (PIM) 142, a connect module 144 and an IT policy module 146. A message application 138 can be any suitable software program that allows a user of the mobile device 100 to send and receive electronic messages, wherein messages are typically stored in the flash memory 108 of the mobile device 100. A device state module 140 provides persistence, i.e. the device state module 140 ensures that important device data is stored in persistent memory, such as the flash memory 108, so that the data is not lost when the mobile device 100 is turned off or loses power. A PIM 142 includes functionality for organizing and managing data items of interest to the user, such as, but not limited to, e-mail, contacts, calendar events, and voice mails, and may interact with the wireless network 200. A connect module 144 implements the communication protocols that are required for the mobile device 100 to communicate with the wireless infrastructure and any host system, such as an enterprise system, that the mobile device 100 is authorized to interface with. An IT policy module 146 receives IT policy data that encodes the IT policy, and may be responsible for organizing and securing rules such as the "Set Maximum Password Attempts" IT policy.

Other types of software applications or components 139 can also be installed on the mobile device 100. These software applications 139 can be pre-installed applications (i.e. other than message application 138) or third party applications, which are added after the manufacture of the mobile device 100. Examples of third party applications include games, calculators. utilities. etc.

The additional applications 139 can be loaded onto the mobile device 100 through at least one of the wireless network 200, the auxiliary 1/O subsystem 112, the data port 114, the short-range communications subsystem 122, or any other suitable device subsystem 124.

The data port 114 can be any suitable port that enables data communication between the mobile device 100 and another computing device. The data port 114 can be a serial or a parallel port. In some instances, the data port 114 can be a USB port that includes data lines for data transfer and a supply line that can provide a charging Current to charge the battery 130 of the mobile device 100.

For voice communications, received signals are output to the speaker 118, and signals for transmission are generated by the microphone 120. Although voice or audio signal output is accomplished primarily through the speaker 118, the display 110 can also be used to provide additional information such as the identity of a calling party, duration of a voice call, or other voice call related information.

Figure 4:
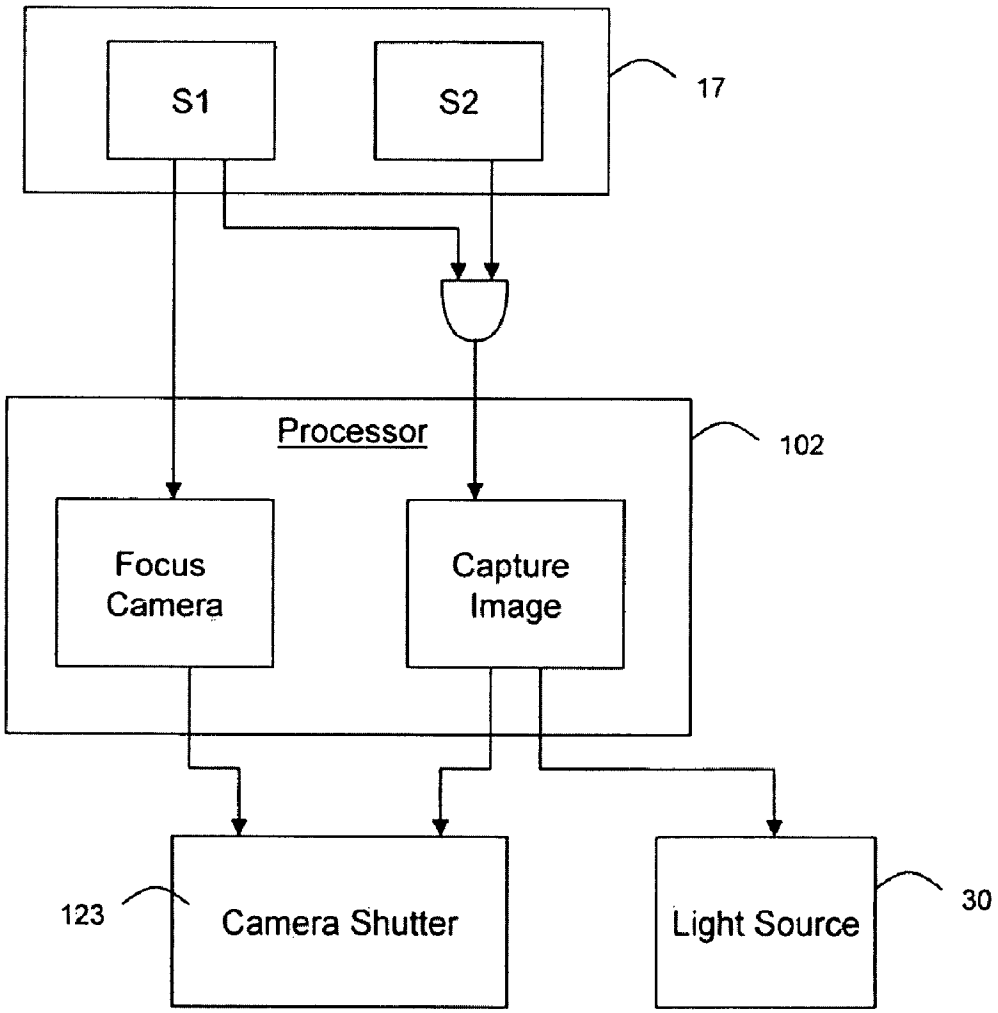
FIG. 4 is a block diagram of an exemplary embodiment of an electronic circuit for a camera system.

Referring to FIG. 4, a representation of an electrical diagram is shown for a camera device. The camera button 17 in this representation comprises two switches, S1 and S2. The activation of switch S1 alone may initiate the camera focusing functionality within the processor 102 and camera shutter 123. The combined activation of switches S1 and S2 may activate the process to capture an image, which may comprise activating the camera shutter 123 and creating a flash of light from a light source 30. In a general two-stage camera button 17, the first switch S1 is activated first to focus the camera, followed by the activation of the second switch S2 to capture the image. It is appreciated that S1 remains active while S2 is activated.

Figure 5:
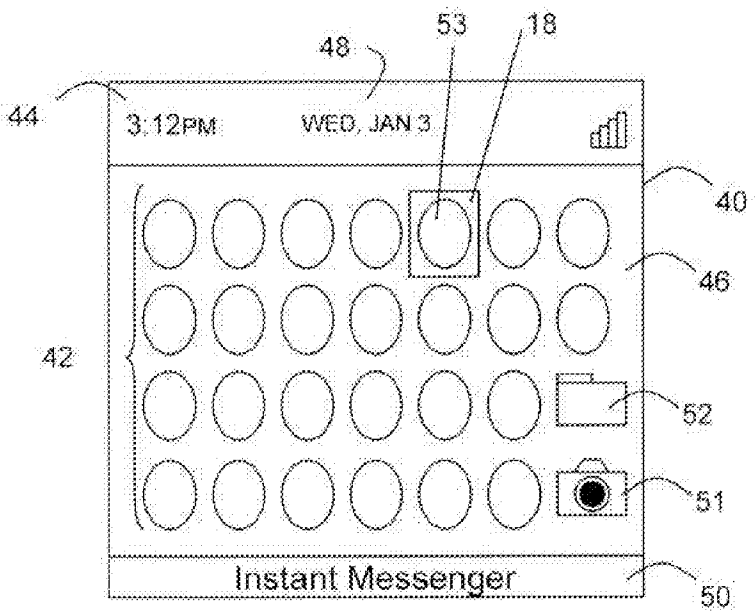
FIG. 5 is a screen shot of a home screen displayed by the mobile device.

Turning now to FIG. 5, the mobile device 100 may display a home screen 40, which can be set as the active screen when the mobile device 100 is powered up and may constitute the main ribbon application. The home screen 40 generally comprises-a status region 44 and a theme background 46, which provides a graphical background for the display 12. The theme background 46 displays a series of icons 42 in a predefined arrangement on a graphical background. In some themes, the home screen 40 may limit the number icons 42 shown on the home screen 40 so as to not detract from the theme background 46, particularly where the background 46 is chosen for aesthetic reasons. The theme background 46 shown in FIG. 5 provides a grid of icons. It will be appreciated that preferably several themes are available for the user to select and that any applicable arrangement may be used. An exemplary icon may be a camera icon 51 used to indicate the camera application. One or more of the series of icons 42 is typically a folder 52 that itself is capable of organizing any number of applications therewithin.

The status region 44 in this embodiment comprises a date/time display 48. The theme background 46, in addition to a graphical background and the series of icons 42, also comprises a status bar 50. The status bar 50 provides information to the user based on the location of the selection cursor 18, e.g. by displaying a name for the icon 53 that is currently highlighted.

An application, such as message application 138 may be initiated (opened or viewed) from display 12 by highlighting a corresponding icon 53 using the positioning device 14 and providing a suitable user input to the mobile device 100. For example, message application 138 may be initiated by moving the positioning device 14 such that the icon 53 is highlighted by the selection box 18 as shown in FIG. 5 and providing a selection input, e.g. by pressing the trackball 14*b*.

Figure 6:
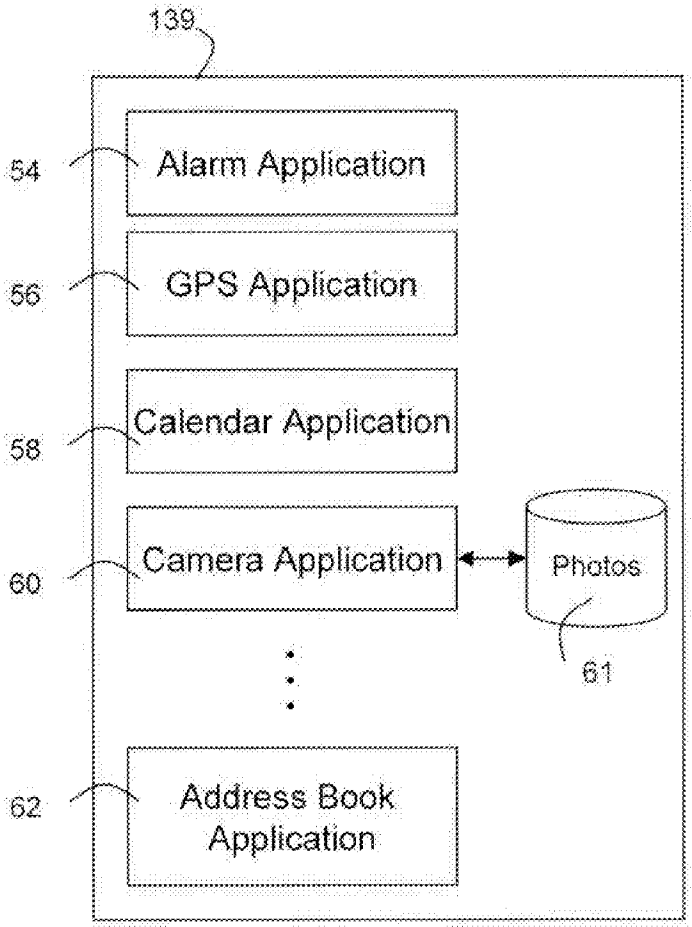
FIG. 6 is a block diagram illustrating exemplary ones of the other software applications and components shown in FIG. 4.

FIG. 6 shows an example of the other software applications and components 139 that may be stored and used on the mobile device 100. Only examples are shown in FIG. 6 and such examples are not to be considered exhaustive. In this example, an alarm application 54 may be used to activate an alarm at a time and date determined by the user. A GPS application 56 may be used to determine the location of a mobile device. A calendar application 58 that may be used to organize appointments. Another exemplary application is a camera application 60 that may be used to focus an image, capture the image into a digital photo, and store the photo for later viewing in a photo or image memory 61 or similar storage device. Another application shown is an address book 62 that is used to store contact information which may include, for example, a phone number, name and e-mail address.

Figure 7:
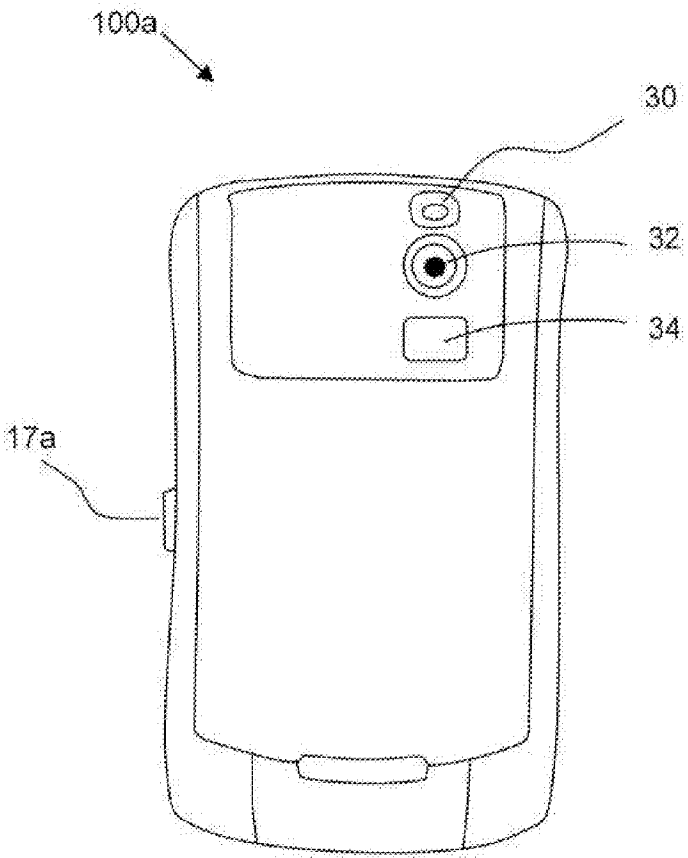
FIG. 7 is a plan view of the back face of the mobile device shown in FIG. 1, and a camera device therefor.

Referring to FIG. 7, the camera application 60 interacts with the structure of the mobile device as shown in one embodiment of a mobile device's rear face. In the rear portion of mobile device 100*a*, for example, there is a light source 30 which may be used to illuminate an object for taking a photo. Also situated on the mobile device's rear face in this example are a camera lens 32 and a reflective surface 34. The camera lens 32 allows the light that represents an image to enter into the camera device. The reflective surface 34 displays an image that is representative of the camera device's view and assists, for example, a user to take a self-portrait photo.

The camera application 60 comprises computer executable instructions that may be activated by pressing a camera button 17, such as the camera button 17*a* shown in FIG. 7. When a first force is applied to the button 17*a*, the camera application 60 may focus the image entering the camera lens 32. The image is typically focused to allow various objects in the image to appear more clearly. When the camera button 17*a* receives a second force that is greater than the first force, then the light source 30 may turn on for a brief moment of time, while the camera shutter captures the image as viewed by the camera lens 32. The camera application 60 then stores the captured image as a digital photo in the photo memory 61.

Figure 8:
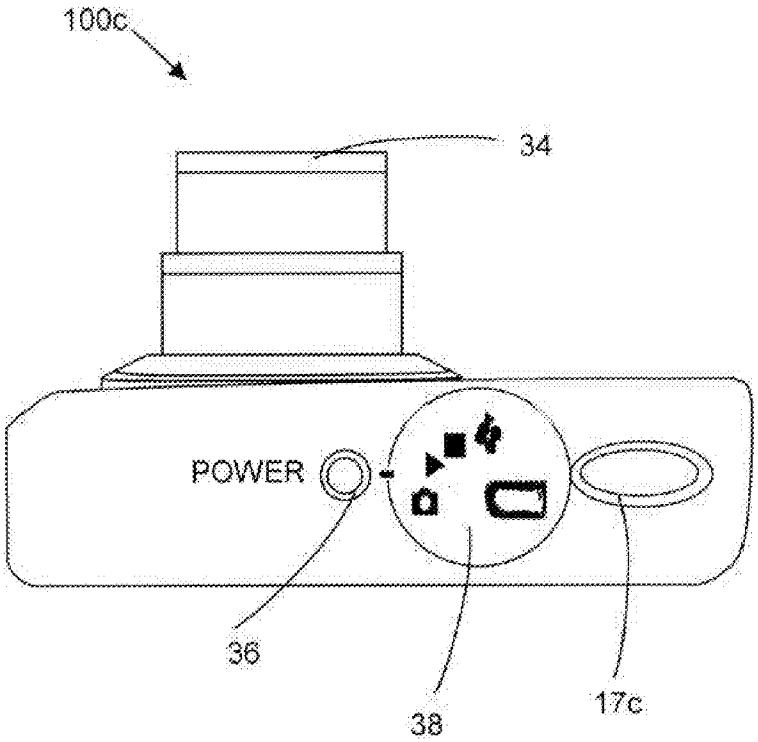
FIG. 8 is a plan view of another electronic device.

The two-stage camera button 17 may also be used on various other devices, such as a dedicated camera 100*c* including, for example, the camera 100*c* shown in FIG. 8. The camera 100*c* in FIG. 8 also includes the two-stage camera button 17*c* that may function by, in the first stage, focusing the image upon receiving a first force. In the second stage, after receiving a second force greater than the first, the button 17 may activate a camera shutter to capture the image into a digital photo. The camera device 100*c* in this example also comprises a lens 34, an on/off or power button 36, and a selection wheel 38 that may be used to select different operating modes.

It may be appreciated that a two-stage button 17 may be used in other devices for various applications that require a two-stage operation, and the principles described herein should not be limited to only activating camera focusing and shutter functions. Other devices and applications may include, for example, setting the time on a watch. In this example, the first stage on the button may be used to advance the time, while the second stage on the button may be used to select and set a certain time. Other applications for the two-stage button 17 may also be used for video recording applications, flash-camera shutter combinations and scroll-through media.

In general, the two-stage button 17 comprises a first switch and a second switch, and more particularly an outer switch and an inner switch. In one embodiment, the outer switch closes first and the inner switch closes second, while in another embodiment a configuration with the inner switch closing first is also applicable to the principles herein. The inner switch comprises a first upper contact and a first lower contact, and the outer switch comprises a second upper contact and a second lower contact, wherein the engagement of an upper and lower contact closes a switch. Embodiments of the two-stage button 17 are provided below.

Figure 9:
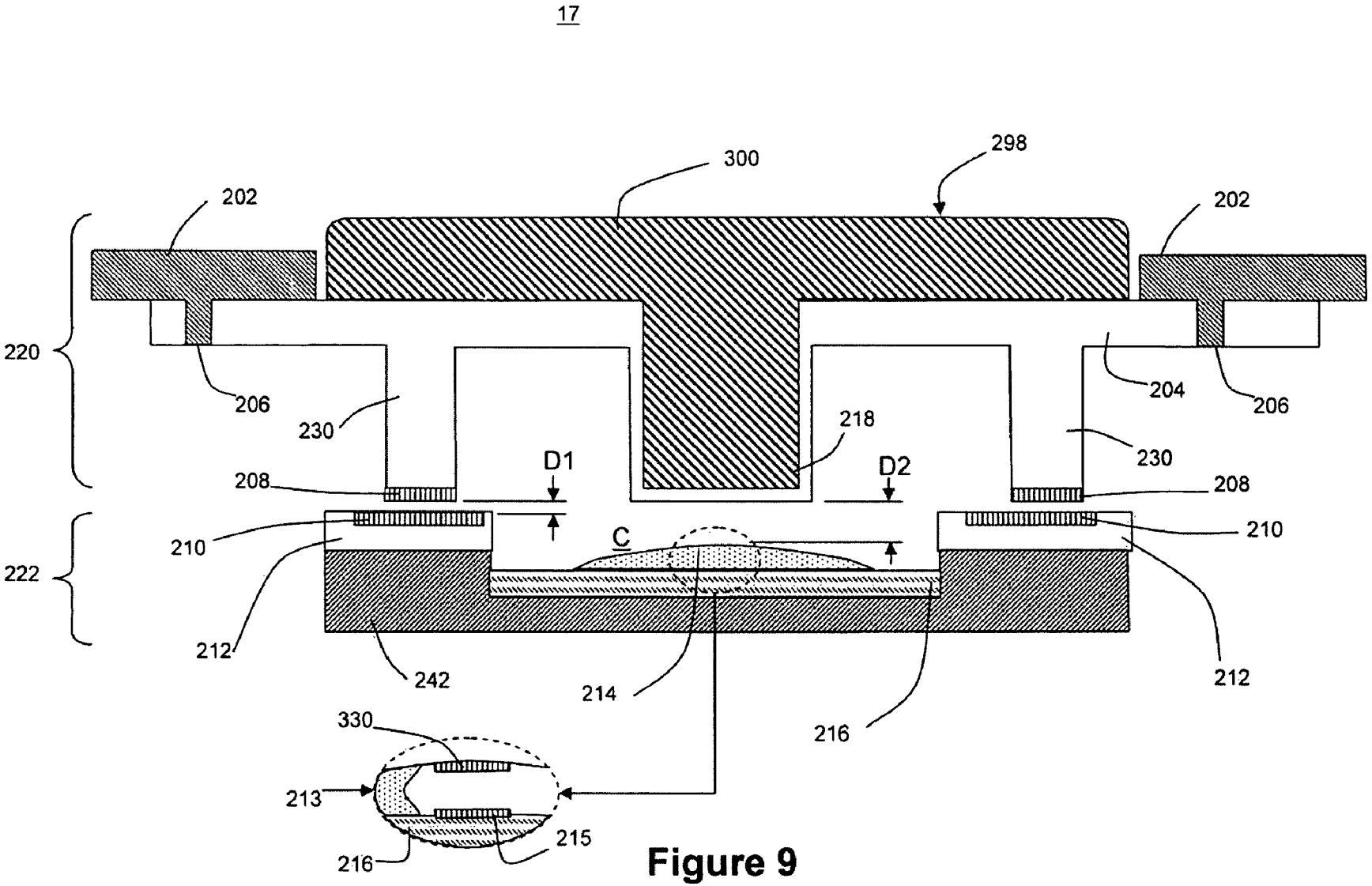
FIG. 9 is a profile view of an exemplary embodiment of a two-stage switch device.

Turning now to FIG. 9, the two-stage button 17 comprises an upper assembly 220 and a lower assembly 222. The upper assembly 220 comprises a push key 298, which comprises a resilient form 204, a key cap 300, or the combination thereof. In this embodiment, the push key 298 comprises the combination of the resilient form 204 and key cap 300, wherein the key cap 300 is coupled to the top of the resilient form 204 by way of adhesive, mechanical friction, one or more detents, or other coupling mechanisms. The key cap 300 may comprise a rigid material and is configured and positioned to receive a downward actuation force. Below the broad surface of the key cap 300 is an interior protrusion or actuator 218 that protrudes downwardly towards the lower assembly 222. It may be noted that the actuator 218 and key cap 300 may form a single component or can be assembled from separate components. The resilient form 204 envelopes a portion of the actuator 218 and supports the key cap 300 located above. It may be noted that the resilient form 204 is able to flex and compress, and return to its original form. The resilient form 204 may be constructed from, for example, a soft rubber or plastic material. The resilient form 204 is also secured to an external housing or case 202 of the electronic device 100 in this example using attachment points 206, located toward the periphery of the two-stage button 17. The attachment points 206 may be secured using various approaches comprising, for example, a heat staking method, a snap fastener assembly or adhesive compound.

The resilient form 204 also comprises a peripheral protrusion, in this case a resilient protrusion 230, which partially or completely encircles the outer perimeter of the actuator 218. It can be appreciated that the resilient protrusion 230 forms part of the outer switch and the actuator 218 forms part of the inner switch. The resilient protrusion 230 is generally concentric with the actuator 218. Secured to the bottom portion of the resilient protrusion 230 is an upper conductive surface or second upper contact 208, comprising electrically conductive material. Examples of applicable conductive materials may comprise graphite, gold and copper. The second upper contact 208 forms part of the upper portion of the outer switch.

The resilient protrusion 230 and attached second upper contact 208 are not limited to any particular geometry and may comprise various other forms, such as a hexagon, square, circle, etc.

The lower assembly 222 of the two-stage button 17 comprises a lower conductive surface or second lower contact 210 that is positioned directly below the second upper contact 208. The second lower contact 210 forms part of the outer switch. Situated within the inner perimeter of the second lower contact 210 is a cavity C comprising a dome switch 214 supported on a dome base 216. The dome switch 214, which forms part of the inner switch, is positioned directly below the actuator 218. It is recognized that the second lower contact 210 may partially or completely encircle the outer perimeter of the dome switch 214. In one embodiment, the geometry of the lower conductive surface 210 generally matches the geometry of the second upper contact 208. It is recognized however, that the second upper contact 208 and second lower contact 210 may have different geometries, given that a portion of the second upper contact 208 is aligned directly above a portion of the second lower contact 210. The alignment between the second upper and second lower contact surfaces 208, 210 allow the two surfaces to come into contact when the one conductive surface moves relatively towards the other conductive surface.

In the lower assembly 222, the lower conductive surface 210 may be secured to a printed circuit board (PCB) or base 212, for example, a flexible PCB. The PCB 210 and dome base 216 are supported from below by a rigid housing 242. The portion of the rigid housing 242 located below the actuator 218, is lowered to create a cavity wherein the dome switch 214 and dome base 216 are located.

The dome switch 214 is not limited to any particular type. A dome switch 214 however, that is stiffer, such as a metal dome switch, may be used to facilitate stronger tactile feedback for a user pressing the two-stage button 17. In FIG. 9, a partial cross-sectional view 213 of the dome switch's interior is shown. It is appreciated that the interior apex of the dome has a first upper contact 330 (e.g. an electrically conductive surface) spaced in alignment above a first lower contact 215 at the dome base 216, such that when the dome collapses and the two dome contacts 330, 215 engage, the dome switch 214 is closed.

In this example, the two-stage button 17 comprises two separate switches, wherein the outer switch comprises the second upper contact 208 and the second lower contact 210, and the inner switch comprises a first upper contact 330 and first lower 215 contact housed within a dome switch 214. The distance D1 between the two second contacts 208. 210 is less than the distance D2 between the bottom surface of the actuator 218 and apex of the dome switch 214 to allow the outer switch to be activated before the inner switch. In other words, when the two-stage button 17 is in a neutral position, D1 is less than D2. Therefore, when the two-stage button 17 receives a first force, the second upper contact 208 travels a distance of D1 to engage the second lower contact 210 and to close the circuit for the outer switch. The distance D1 is insufficient for the actuator 218 to collapse the dome switch 214. When the two-stage button 17 receives a second force that is greater than the first force, the outer switch remains engaged, and the actuator 18 travels the entire distance D2 to collapse the dome switch 214 and to close the circuit for the inner switch.

In this embodiment, shown in FIG. 9, the bottom surface of the actuator 218 is generally in the same horizontal plane as the upper conductive surface 208. The difference in height between D1 and D2 is created by placing the apex of the dome switch 214 below the horizontal plane defined by the lower conductive surface 210. Other configurations that allow for distance D2 to be greater than distance D1 are also equally applicable.

It is also appreciated, that in the embodiment shown in FIG. 9, a minimum of at least one second upper contact 208 is needed to engage the second lower contact 210 to close a circuit.

Figure 10:
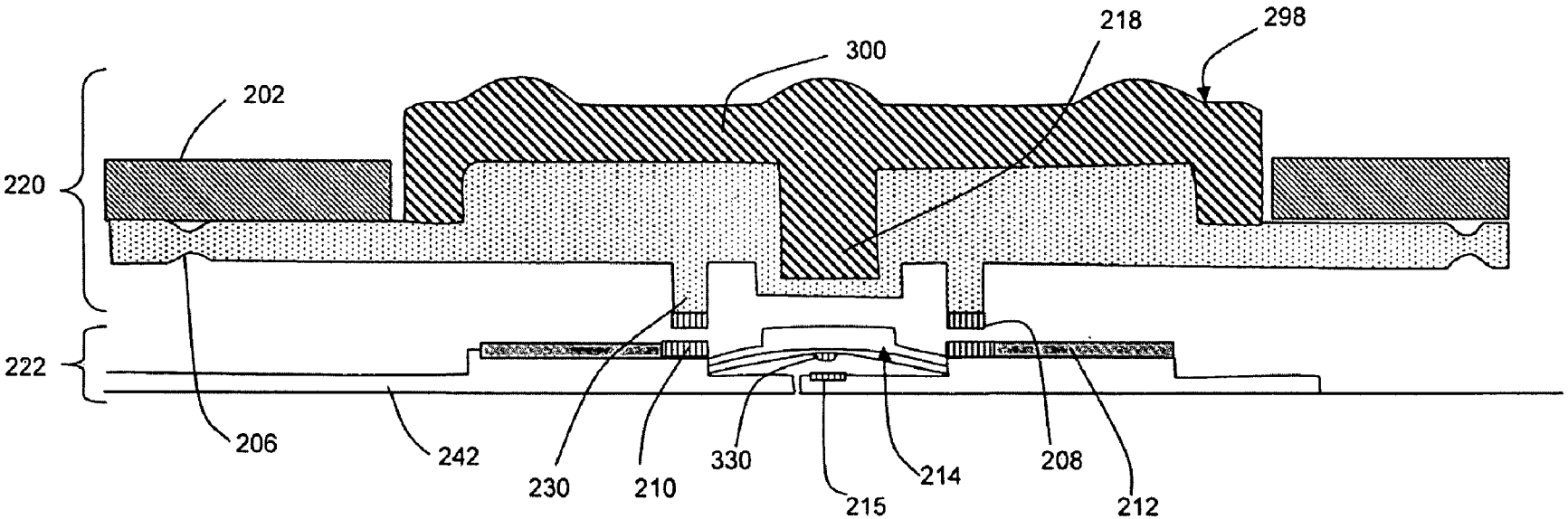
FIG. 10 is a profile view of another embodiment of a two-stage switch device.

FIG. 10 shows another embodiment of the two-stage switch from a cross-sectional elevation view. The push key 298 shown in this embodiment comprises a resilient form 204 and a push key 300. The interior protrusion or actuator 218, and peripheral protrusion or resilient protrusion 230 in this embodiment have a circular geometry. It is also recognized that an alternate configuration allows for the difference in the distances D1 and D2. In this embodiment, the bottom surface of the actuator 218 is located above the horizontal plane defined by the upper conductive surface 208, thereby increasing the distance D2, between the apex of the dome switch 214 and the actuator 218, over the distance D1.

Figure 11:
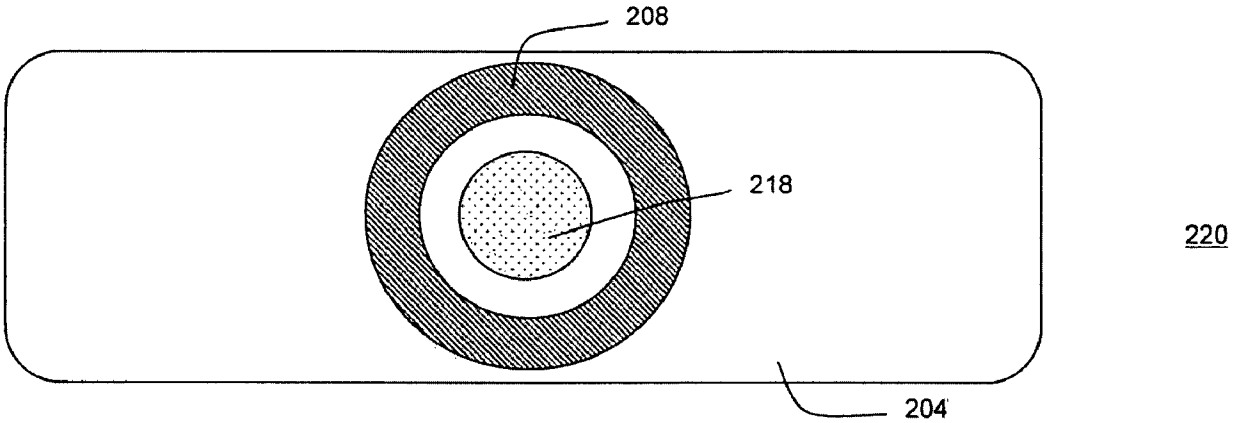
FIG. 11 is a plan view of an exemplary upper assembly of the two-stage switch device shown in FIG. 9 in isolation.

Referring to FIG. 11, an embodiment of an upper assembly 220 is shown from a planar view. The upper assembly 220 in this embodiment comprises a circular actuator 218, completely encircled by a circular resilient protrusion 230. Attached to the bottom surface of the resilient protrusion 208 is a second upper contact 208, also completely encircling the actuator 218.

Figure 12:
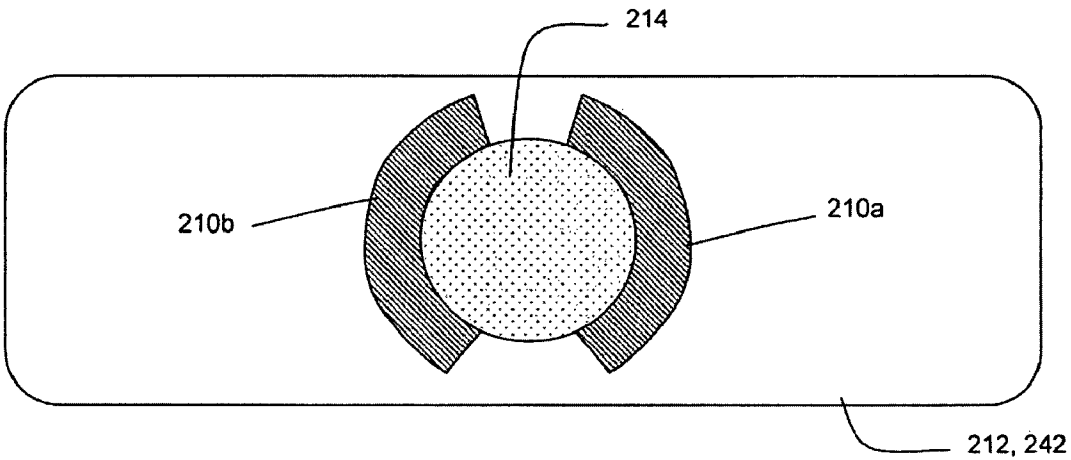
FIG. 12 is a plan view of an exemplary lower assembly of the two-stage switch device shown in FIG. 9 in isolation.

FIG. 12 shows an embodiment of a lower assembly 222 corresponding to the upper assembly 220 shown in FIG. 11. In this embodiment, the second lower contact 210 partially encircles the dome switch 214 and the second lower contact 210 is separated into two parts 210*a*, 210*b*. It is noted that the second lower contact 210*a*, 210*b* has a circular geometry that matches the second upper contact 208. The similar geometry between the second upper and second lower contacts 208, 210 allows for a greater surface area to be in contact with each other when the two contacts 208, 210 are engaged.

Figure 13:
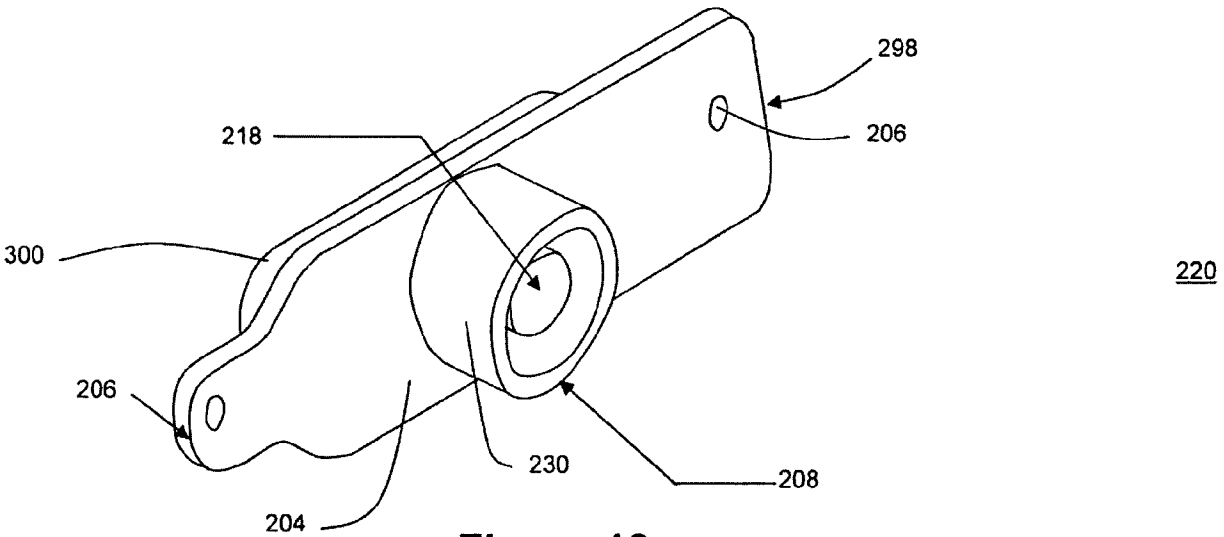
FIG. 13 is a perspective view of another embodiment of the upper assembly of the two-stage switch assembly shown in FIG. 10 in isolation.

FIG. 13 shows a perspective view of another embodiment of the upper assembly 220. This embodiment also comprises a resilient protrusion 208 extending from the resilient form 204, and completely encircling an actuator 218. Also shown with more clarity are two attachment points 206, in this embodiment comprise through-holes, that are located towards the peripheral portions of the resilient form 204 and are used to facilitate the use of mechanical fasteners.

Figure 14:
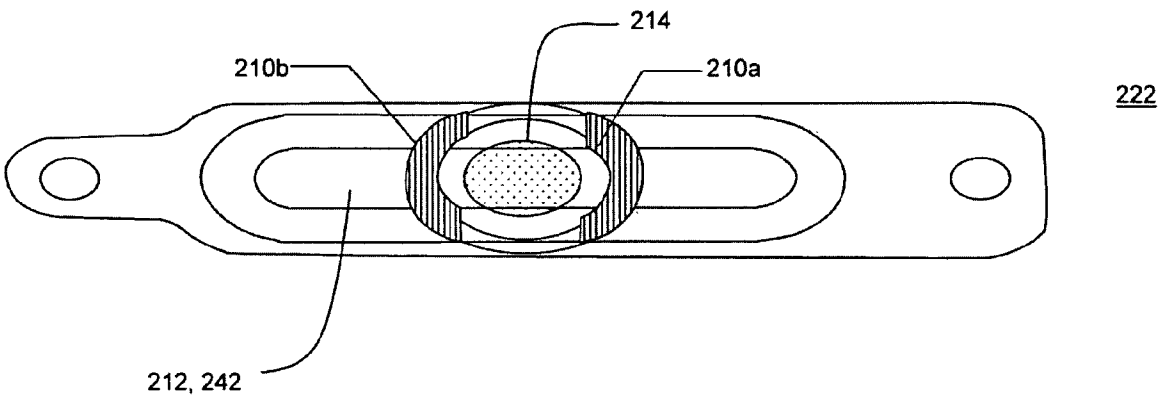
FIG. 14 is a perspective view of another embodiment of the lower assembly of the two-stage switch assembly shown in FIG. 10 in isolation.

FIG. 14 also shows a perspective view of an embodiment of a lower assembly 222 that corresponds with the upper assembly 220 shown in FIG. 13. An overlay of the upper assembly 220 is outlined above the lower assembly 222. The second lower contact parts 210*a*, 210*b* are shown as being aligned With the outline of the second upper contact 210.

Figure 15:
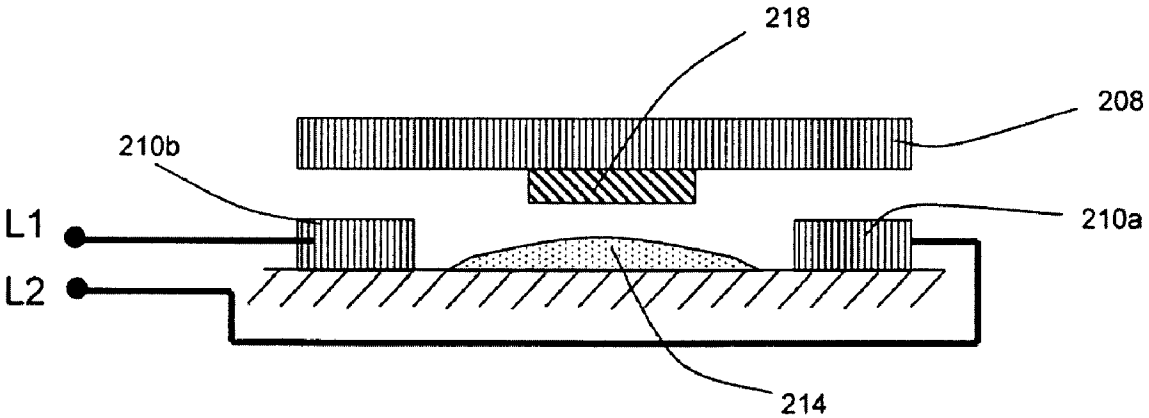
FIG. 15 is an electrical schematic comprising the upper conductive surface and lower conductive surface.

Turning now to FIG. 15 an embodiment of an electrical circuit configuration for the outer switch is shown. In an embodiment comprising a second upper contact 208 completely encircling the actuator 218 and a second lower contact 210 separated into two parts 210*a*, 210*b*, the two electrical leads L1 and L2 may be each connected to a separate second lower contact part 210*a*, 210*b*. In this embodiment, electrical lead L1 is connected to one second lower contact 210*b*, and electrical lead L2 is connected to another second lower contact 210*a*. The leads. L1 and L2, are electrically isolated from one another since the second lower contacts 210*a*, 210*b* are also electrically isolated from one another. When the second upper contact 208 engages the second lower contact 210, the separate parts 210*a*, 210*b* are electrically connected, thereby closing the circuit between electrical leads L1 and L2.

Figure 16:
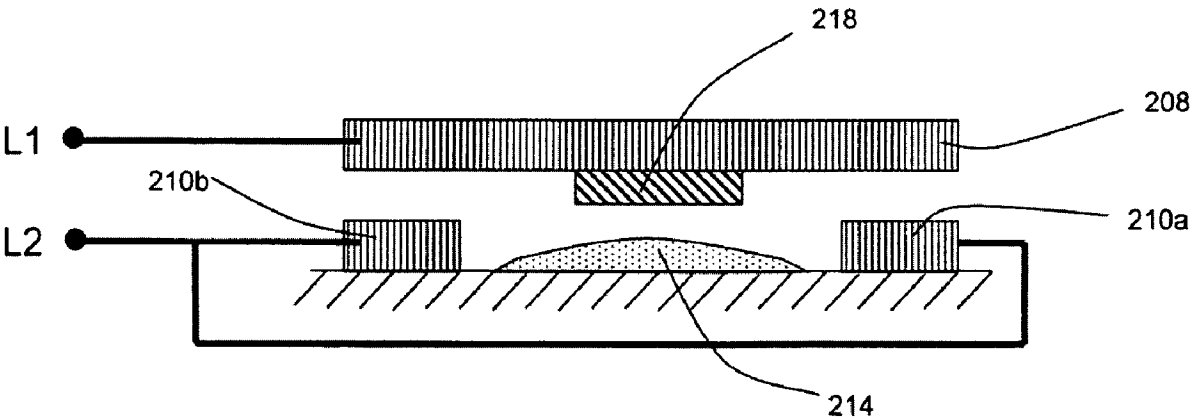
FIG. 16 is another embodiment of an electrical schematic comprising the upper conductive surface and lower conductive surface.

FIG. 16 shows another embodiment of an electrical circuit configuration for the outer switch. Similar to the embodiment in FIG. 15, the second lower contact 210 is separated into two parts 210*a*, 210*b*. In this embodiment however, the separate second lower contacts 210*a*, 210*b* are electrically connected to one another by electrical lead L2. It is noted that lead L1 is connected to the second upper contact 208. Therefore, when there are no downward forces acting on the two-stage button 17, and the button 17 is in a neutral position, then the other electrical lead L1 is electrically isolated from lead L2. Only when the second upper contact 208 engages at least one of the second lower contacts 210*a*, 210*b*, then the leads, L1 and L2, become electrically connected, thereby closing the circuit for the outer switch.

It may be noted that other electrical configurations that allow two leads, L1 and L2, to be connected when the second upper contact 208 engages the second lower contact 210, are equally applicable. The electrical configurations may depend on the various configurations in the second upper and lower contacts 208, 210, which may each comprise a single surface or separate surfaces.

Figure 17:
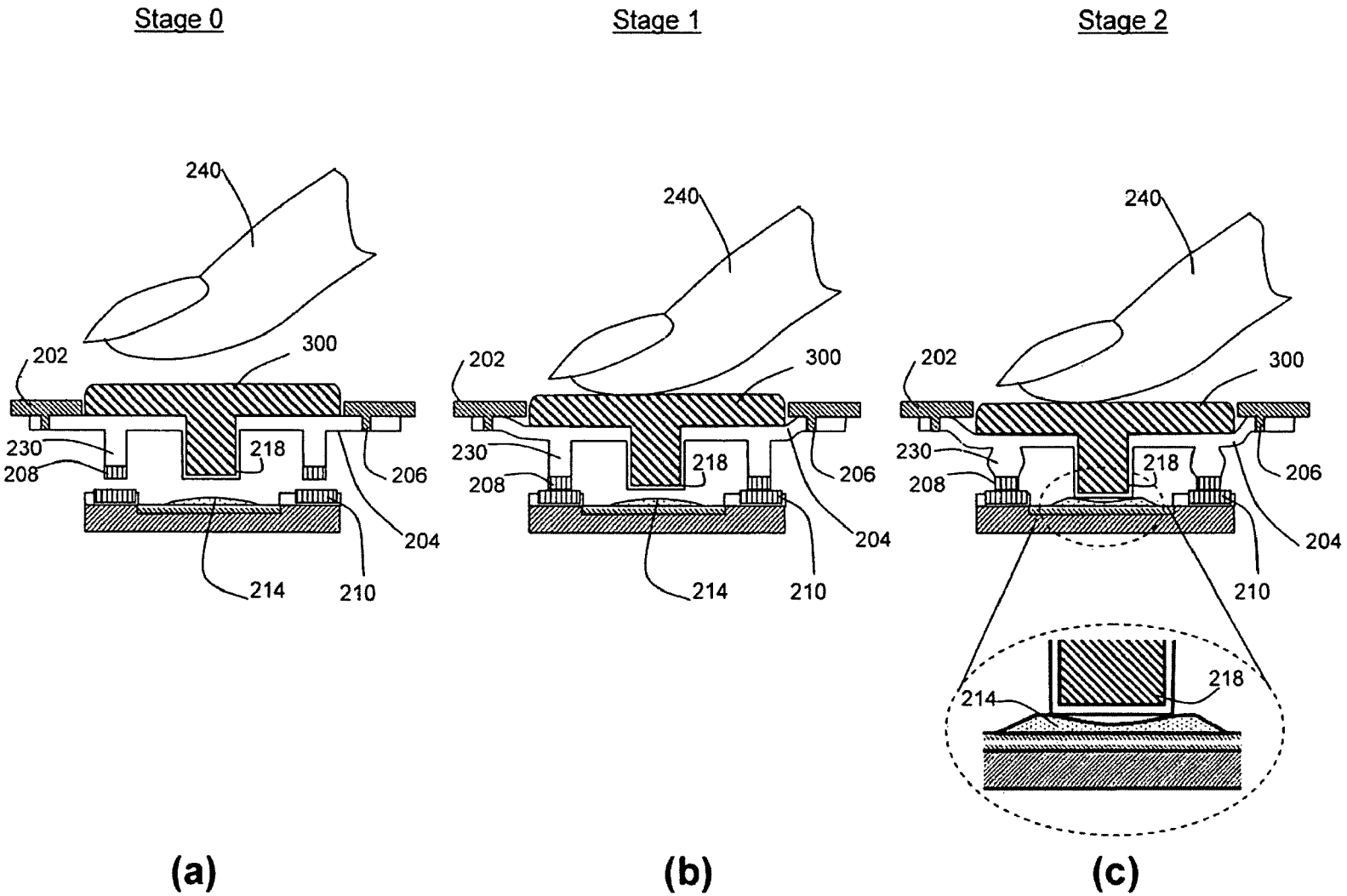
FIGS. 17(*a*) through 17(*c*) illustrate exemplary stages of operation the two-stage switch assembly shown in FIG. 9.

Referring now to FIG. 17, the stages of operation of the two-stage button 17 are shown in greater detail using a series of cross-sectional views. In this embodiment, there are three stages in the operation of the button 17, the first stage (Stage 0) being a neutral or rest position. In Stage 0, neither the outer switch nor the inner switch is activated, that is both switches are at rest. In Stage 1, only one of the inner or outer switches is activated. In Stage 2, the both the inner and outer switches are activated. In this embodiment, the outer switch activates before the inner switch.

In Stage 0, shown in FIG. 17(*a*), no force is applied to the key cap 300. The resilient form 204 supports the second upper contact 208 away from the second lower contact 210 to prevent engagement there between, and prevents the actuator 218 from engaging the dome switch 214. Therefore, the support generated by the resilient form 204 in neutral position prevents both the first switch and second switch from activating until experiencing an external force.

In Stage 1, shown in FIG. 17(*b*), the user may apply a first downward force that acts on the key cap 300 by pressing down on the key cap 300 with, for example, a finger 240. In other examples, a finger may push against an additional structure, such as a trackball or trackwheel or other actuation device, which in turn depresses the key cap or push key 300. In general, the key cap 300 receives the first downward force and transfers the force throughout the resilient form 204. The downward translation of the key cap 300 causes the resilient form 204 to move away from the external casing 202 and towards the lower assembly 222, thereby also advancing the resilient protrusion 230 towards the lower assembly 222. After the resilient protrusion 230 travels a distance of D1, the upper conductive surface 208 engages the lower conductive surface 210, and closes the circuit for the first switch. In the example of a camera application, the camera would focus the incoming image during this stage. It can be seen that in Stage 1 the actuator 218 has not engaged the dome switch 214, since the actuator 218 has not travelled the required distance D2.

During Stage 1, the force required to lower the resilient form 204 to engage the first switch is relatively small compared to the force required to collapse the second switch, i.e. the dome switch 314 in this example. As the second upper contact 208 engages the second lower contact 210, the user experiences tactile feedback that feels like a "soft stop." This type of tactile feedback may allow the users to recognize that the two-stage button 17 has activated Stage 1.

The tactile feedback may vary according to the type of material used in the resilient form 204. A harder rubber, for example, may require more force to flex the resilient form 204, while a softer rubber may require less force. Furthermore, varying the thickness of the resilient form 204 in various areas may be used to modify the tactile feedback. For example, if the layer of resilient form 204 that envelopes the actuator 218 is increased in thickness, a different tactile feel may be experienced such that the two-stage button 17 feels firmer.

In Stage 2, shown in FIG. 17(*c*), the user increases the applied downward force onto the key cap 300. This second force, which is greater than the first force, is received by the key cap 300 and may cause the key cap 300 to displace further towards the lower assembly 222. The peripheral portions of the resilient form 204, which are near the attachment points 206, flex, extend or deform as the key cap 300 translates downwards. It is noted that the resilient protrusion 230 may deflect, compress or otherwise deform while the key cap 300 moves further down. Throughout Stage 2, the second upper contact 208 remains in contact with the second lower contact 208. When the actuator 218 travels downwards a distance of D2, the actuator 218 engages the switch dome 214, and therefore causes the dome switch 214 to collapse. When the dome switch 214 collapses, the first upper contact 330 engages the first lower contact 215. The collapsing of the dome switch 214 is, in this example, used to close the circuit for the second switch. In the example of a camera application, Stage 2 may be used to activate the camera shutter to capture an image.

During Stage 2, the user experiences tactile feedback indicating that the second switch has been activated. The sudden collapse of the dome switch 214 may feel like a "hard stop" to the user. The differences between the "soft stop" tactile signal ad the "hard stop" tactile signal allow the user to distinguish between the activation of the first switch and the second switch.

When the force acting downwards on the key cap 300 is removed, the resilient form 204 regains its original shape and returns the resilient protrusion 230, second upper contact 208, actuator 218 and key cap 300 to the neutral position, as shown in Stage 0. When the actuator 219 disengages the dome switch 214, the dome switch 214 returns to its original form and opens the inner switch. Similarly, when the second upper contact 208 disengages the second lower contact 210, the outer switch is also opened.

Figure 18:
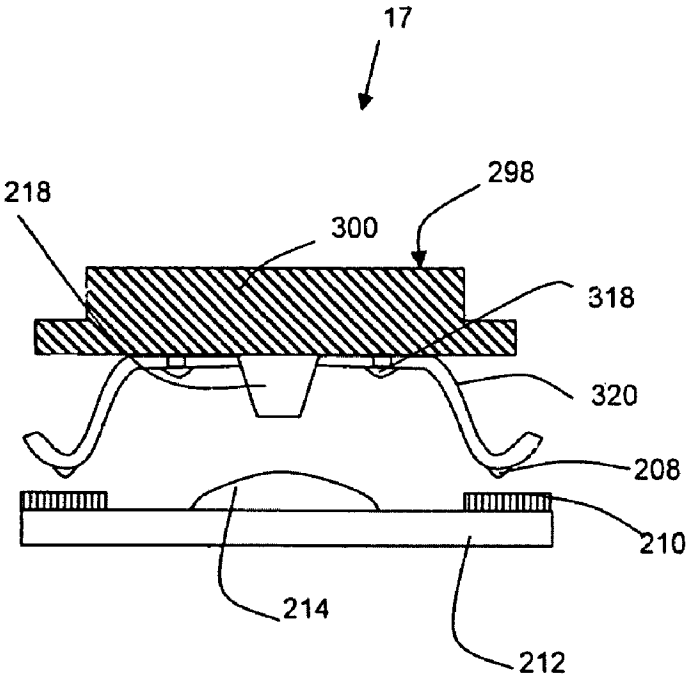
FIG. 18 is profile view of another exemplary embodiment of a two-stage switch device.

FIG. 18 shows another embodiment of a two-stage button 17 wherein the push key 300 comprises a key cap 300. In particular, the upper assembly comprises a key cap 300, an interior protrusion or actuator 218, and peripheral resilient arches 320 attachable to the key cap 300. The resilient arches 320 may be attachable by adhesives, melting methods, and mechanical mechanisms, such as fasteners 318. The resilient arches 320 in this embodiment may partially or completely surround the outer perimeter of the actuator 218. The bottom surface of the resilient arch 320 may comprise conductive material to form a second upper contact 208, that allows it to engage a second lower contact 210. It is appreciated that the second upper contact 208 and the resilient arch 320 may, or may not, form a single component. The resilient arch 320 in this example comprises a partially rigid material, able to flex or deflect when the upper assembly translates downwards toward the lower conductive surface 210. Examples of partially rigid materials are various flexible metals or plastics that may or may not be electrically conductive. The resilient arch 320 may also have a frusto-conical configuration. It is appreciated that in the outer switch, surrounding the outer perimeter of the dome switch 214 and actuator 218, the contact between the second upper contact 208 and the second lower contact 210 may close an electrical circuit, and that various current paths to accomplish closing the circuit of the outer switch may be equally applicable.

Figure 19:
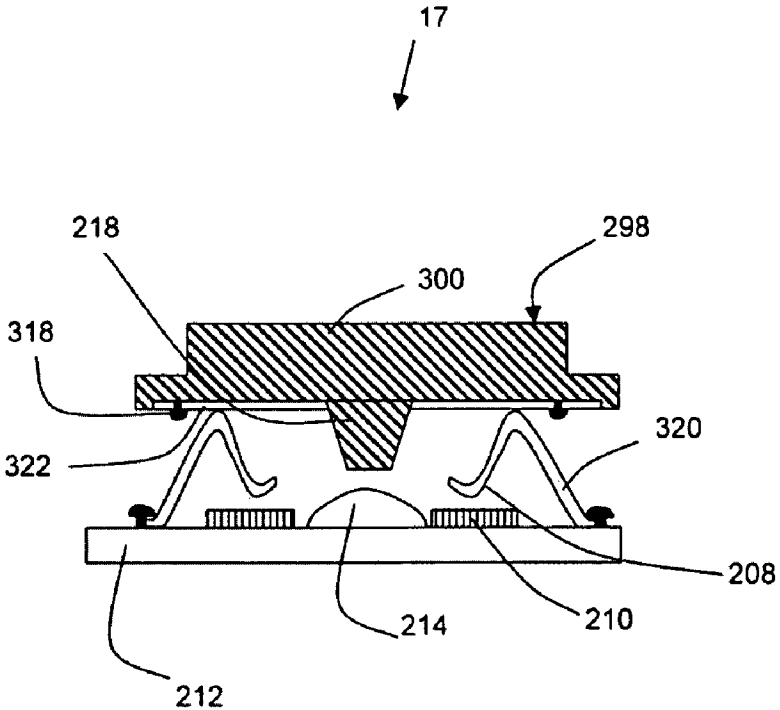
FIG. 19 is profile view of yet another exemplary embodiment of a two-stage switch device.

FIG. 19 shows vet another embodiment of a two-stage button 17, wherein the upper assembly comprises a key cap 300, an upper surface 322 and an interior protrusion or actuator 218. The lower assembly may comprise one or more peripheral protrusions, in this case resilient arches 320, a second lower contact 210 and a dome switch 214. The resilient arches 320 may partially or completely surround the outer perimeter of the dome switch 214, and in this example arch upwards towards the key cap 300 and extend downwards towards the lower conductive surface 210. A resilient arch 320 may comprise electrically conductive material and maintains contact with the upper surface 322 by way of the upper portion of the arch, while a lower portion of a resilient arch 320, in this case the second upper contact 208, is positioned above a second lower contact 210 such that the second upper contact 208 is able to engage the second lower contact 210. The second upper contact 208 and resilient arch 320 may, or may not, form a single component. The upper surface 322 may be attachable to the key cap 300, and the resilient arching member 320 may be attachable to the PCB 212, wherein the attachment may utilize adhesives, melting methods, and mechanical mechanisms, such as fasteners 318. In one embodiment, the resilient arch 320 has a frusto-conical configuration. In a rest or neutral position of the two-stage button 17, the upper conductive surface 208 is not in contact with the lower conductive surface 210. When the key cap 300 receives a downward force, the key cap 300 pushes down on the upper portion of the resilient arch members 320, and thereby causes the second upper contact 208 to move downwards to engage the second lower contact 210. During this engagement, the resilient arch 320 is caused to flex or deflect. The contact between the second upper contact 208 and the second lower contact 210 closes an electrical circuit. An example of a current path may comprise two electrical terminals that fort the lower conductive surface 210, which are electrically connected by the second upper contact 208. In another example of a current path, one electrical terminal is connected to a resilient arch 320 while the other electrical terminal is connected to the second lower contact 210. In yet another example of an alternate current path, one electrical terminal may be connected to the upper surface 322, while the other electrical terminal may be connected to the second lower contact 210. It is appreciated that in the outer switch, surrounding the outer perimeter of the dome switch 214 and actuator 218, generally the contact between the second upper contact 208 and the second lower contact 210 closes an electrical circuit, and that various current paths used to accomplish closing the circuit of the outer switch are equally applicable.

Figure 20:
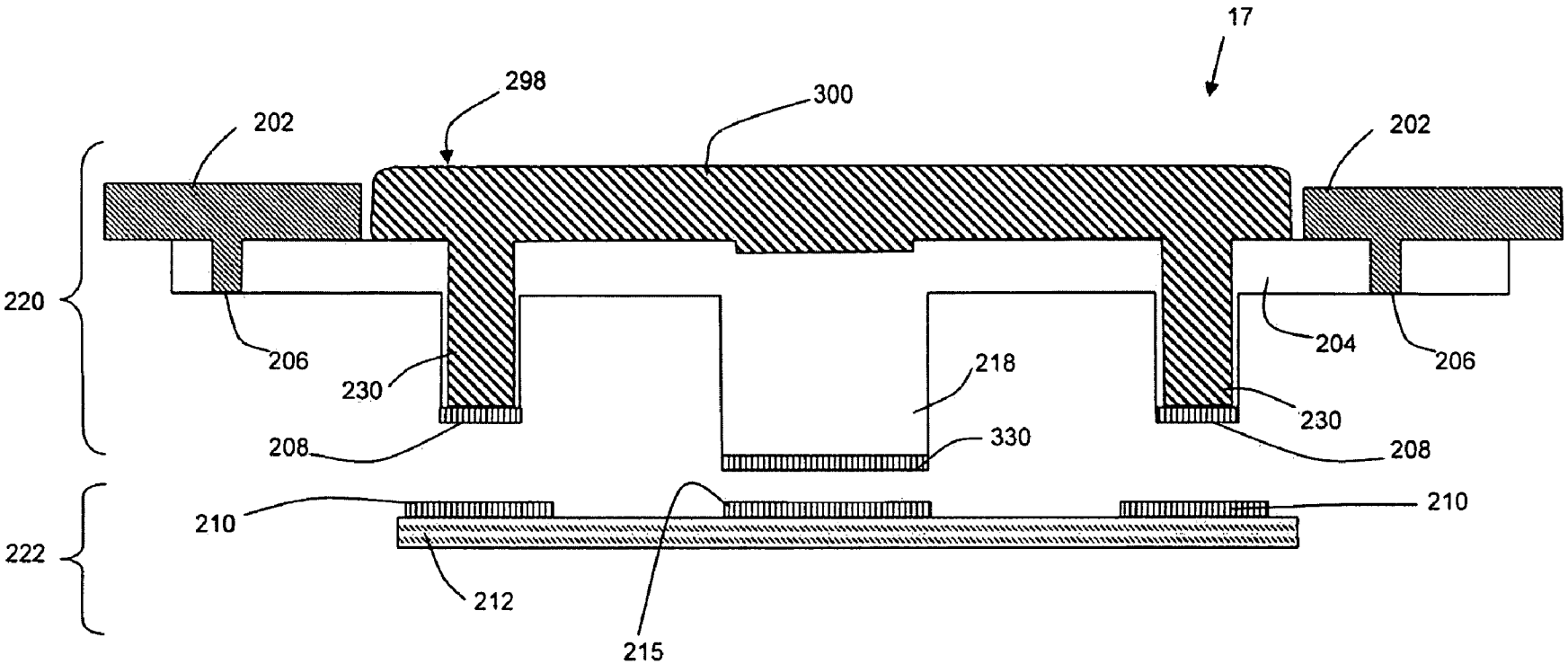
FIG. 20 is profile view of yet another exemplary embodiment of a two-stage switch device.

Turning to FIG. 20, another embodiment of a two-stage switch 17 is shown with the inner switch spaced within the interior of the outer switch, and the inner switch having a longer profile than the outer switch. The inner switch comprises an interior protrusion, in this case a resilient actuator 218 having a electrically conductive contact pad, or first tipper contact, 330 on its end and is spaced in alignment with a second electrically conductive contact pad, or first lower contact, 215 located on a PCB 212 below. The resilient actuator 218 comprises a resilient material, such that when the key cap 300 is pressed downwards, the first switch is closed first. When the first upper and lower contacts 330, 215 engage one another, the resilient actuator 218 may resiliently deform and continue to compress. As the key cap 300 continues to move downward, the second switch engages. The second switch comprises a peripheral protrusion, in this case a peripheral actuator 230, having a shorter profile when compared to the resilient actuator 218. Unlike the resilient actuator 218, the peripheral actuator 230 may comprise rigid material and may be integrally formed with the key cap 300. At the ends of the peripheral actuator 230 is a second upper contact 208 spaced in alignment, to a second lower contact 210. When the second upper contact 208 engages the second lower contact 210, the outer switch is closed. It can be seen that this example is similar to the embodiment shown in FIG. 9, however, the inner switch closes first before the peripheral or outer switch since the inner switch has a taller profile compared to the peripheral switch. In a camera application, when the first upper and lower contacts 330, 215 on the inner switch engage, the camera application activates the autofocus function. As the key cap 300 continues moving down, when the outer switch engages, the camera's shutter function activates.

Figure 21:
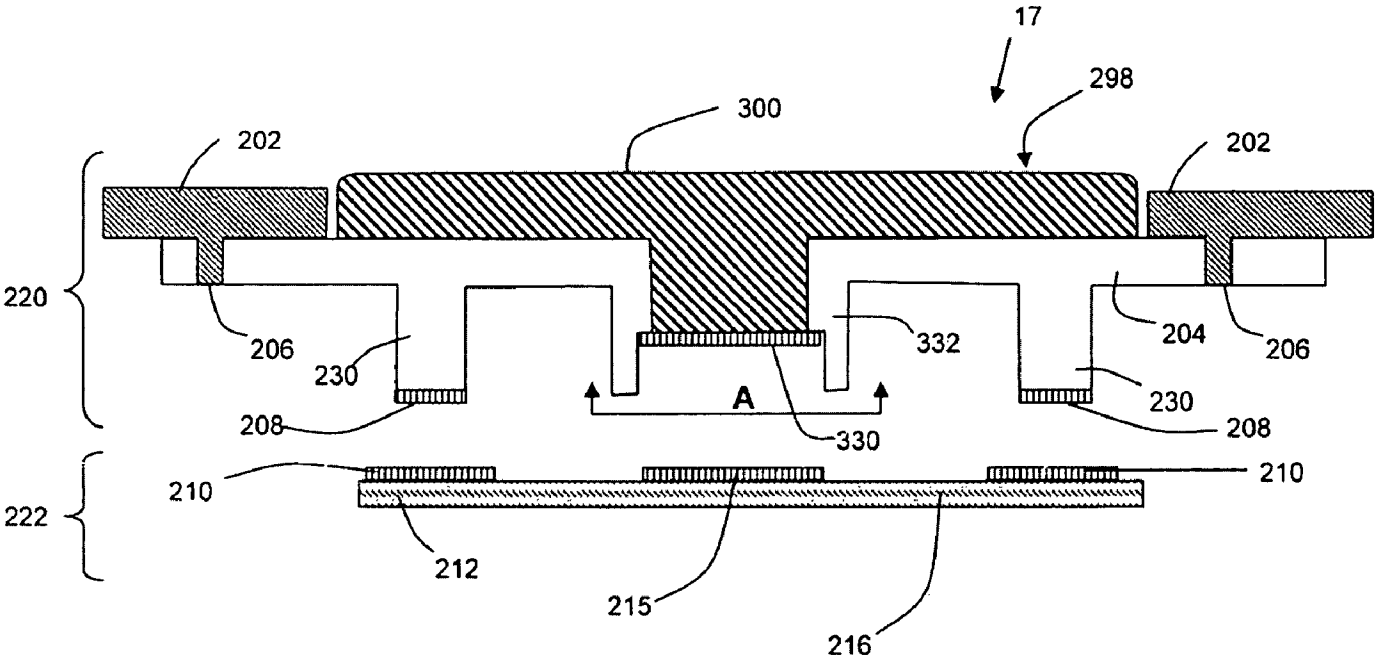
FIG. 21 is profile view of yet another exemplary embodiment of a two-stage switch device.
Figure 23:
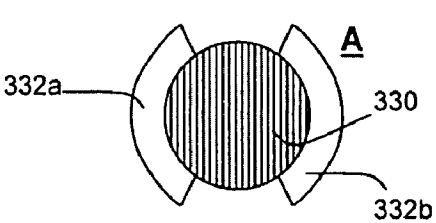
FIG. 23 is plan view of another embodiment of a center flange of the two-stage switch device shown in FIG. 21 in isolation.
Figure 22:
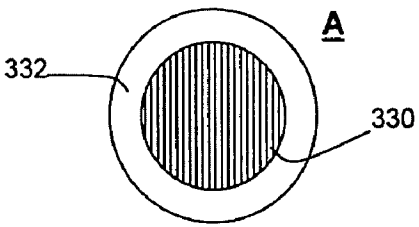
FIG. 22 is plan view of the center flange of the two-stage switch device shown in FIG. 21 in isolation.

FIG. 21 shows another embodiment of a two-stage switch 17. In this embodiment, the outer switch makes an electrical connection before the inner switch. This embodiment is similar to the embodiment shown in FIG. 9. In the upper portion 220 of the switch, a rigid key cap 300 is secured to a resilient form 204 and a peripheral protrusion, in this case a resilient protrusion 230, extends from the form 204. The resilient protrusion 230 has attached a second upper contact 208 spaced in alignment to a second lower contact 210, thereby forming the outer switch. In a camera application, the outer switch engages first to activate an autofocus function. The peripheral switch may partially or completely encapsulate the inner switch. In this embodiment, the inner switch comprises a resilient flange 332 extending from the resilient form 204. The resilient flange 332 completely surrounds the electrically conductive first upper contact 330, as illustrated in FIG. 22. In an alternative embodiment shown in FIG. 23, the flange 332 comprises two or more sections 332*a*, 332*b* that partially surround the upper contact pad 330. Turning back to FIG. 21, as the inner switch collapses, the flange 332 resiliently deforms to increase the tactile feedback associated with the inner switch's activation. When the resilient flange 332 sufficiently deforms for the first upper contact 330 to engage the electrically conductive lower contact pad 215, then inner switch is closed. In a camera application, when the inner switch is closed, the camera's shutter function is activated.

The configuration exemplified herein, wherein the first switch is positioned around the perimeter of the second switch, may afford several advantages. It has been recognized that the resilient protrusion 230 can reduce misalignment with the actuator 218 by partially or completely surrounding the actuator 218. The resilient protrusion 230 may provide directional support for the actuator 218 to travel. The large surface area between the second upper contact 208 and second lower contact 210 may also mitigate misalignment. Furthermore, the vertical distance D1 between the second upper contact 208 and second lower contact 210, as well as the distance D2 between the actuator 218 and dome switch 214, is relatively small and can thus further reduce the chance of misalignment. The vertical distance between the actuator 218 and dome switch 214 in one embodiment may be in the order of, for example, 1 millimetre.

Another advantage of the contact and dome switches used in the various examples shown, is a reduced profile. Laterally positioning the switch mechanisms, such that the outer switch is positioned around the outer perimeter of an inner switch as described herein, can decrease the profile of the button 17 and overall switch assembly, which may be preferred for mobile devices that have limited space. It can also be seen in FIG. 10 that low profile components may be selected to achieve the lower profile noted above. For example, as discussed earlier, a resilient protrusion 230 tends to have a low profile height and as such, using a resilient protrusion 230 can reduce the overall profile height of the two-stage button 17.

Yet another advantage of the contact pad and dome switches used in the button 17 as shown is the tactile feedback provided. The difference in materials that comprise the outer switch and inner switch create distinguishable tactile feedback while maintaining a low profile and mechanical robustness. In one embodiment, the outer switch comprises a resilient protrusion 230 that provides a "soft stop" feel when the first switch is activated. The inner switch comprises a dome switch 214 that may be position within the inner perimeter of the first switch, such that the dome switch 215 may provide a "hard stop" feel when second switch is activated. This distinct tactile feedback may be accomplished using several components which are mechanically robust.

It will be appreciated that the tactile experience for a user may vary according to a range of factors including, but not limited to the size of the finger 400, the size of the button 17, and the way in which the user presses down on the button 17.

In view of the above, it therefore seen that the above embodiments may be generally described as a switch assembly comprising a base with a push key supported above the base. In addition, an inner switch comprising a first upper contact is supported above a first lower contact and actuated by movement of the push key, wherein the lower contact is being supported by the base. There is also an outer switch surrounding at least a portion of the inner switch, such that the outer switch comprises a second upper contact that is actuated by the push key, and the second lower contact is being supported by the base. It is appreciated that a first movement of said push key towards the base engages either the first contacts or the second contacts and a further movement of the push key towards the base engages the other of the first contacts or the second contacts.

It will be appreciated that the particular embodiments shown in the figures and described above are for illustrative purposes only and many other variations can be used according to the principles described. Although the above has been described with reference to certain specific embodiments, various modifications thereof will be apparent to those skilled in the art as outlined in the appended claims.

The invention claimed is:

1. A switch assembly comprising:

a base;

a push key comprising a resilient form securable to an external housing to be in spaced relation above said base;

an inner switch comprising a first upper contact supported above a first lower contact and actuated by movement of said push key, said first lower contact being supported by said base; and, an outer switch surrounding at least a portion of said inner switch, said outer switch comprising a second upper contact supported above a second lower contact and actuated by said push key, said second lower contact being supported by said base;

wherein a first movement of said push key towards said base engages either said first contacts or said second contacts and a further movement of said push key towards said base engages the other of said first contacts or said second contacts through deformation of said resilient form.

2. The switch assembly according to claim 1 wherein said push key comprises a key cap.

3. The switch assembly according to claim 2 wherein said outer switch comprises resilient arches to support said second upper contact.

4. The switch assembly according to claim 3 wherein said resilient arches are supported by the key cap.

5. The switch assembly according to claim 3 wherein said resilient arches are supported by said base.

6. The switch assembly according to claim 2 wherein said outer switch comprises a protrusion extending from said key cap to support said second upper contact.

7. The switch assembly according to claim 2 wherein said inner switch is a dome switch, and a protrusion extending from said key cap engages and collapses said dome switch.

8. The switch assembly according to claim 1 wherein said inner switch is a contact switch comprising a protrusion extending from said resilient form, said protrusion supporting said first upper contact.

9. The switch assembly according to claim 8 wherein said protrusion comprises a resilient flange at least partially surrounding said first upper contact.

10. The switch assembly according to claim 1 wherein said outer switch comprises a protrusion extending from said resilient form to support said second upper contact.

11. The switch assembly according to claim 1 wherein said first movement closes said outer switch and said further movement closes said inner switch.

12. The switch assembly according to claim 1 wherein said outer switch and said inner switch are activated by said push key comprising a key cap supported from below by said resilient form;

said outer switch comprising a resilient protrusion extending towards said base, said resilient protrusion comprising said second upper contact located towards a lower portion of said resilient protrusion and aligned with said second lower contact located below said second lower contact;

said inner switch comprising an actuator extending downwards from said key cap and at least partially enveloped by said resilient form, said actuator positioned within an inner perimeter of said resilient protrusion and aligned directly above a dome switch such that upon said key cap moving downwards, said actuator engages said dome switch and collapses said dome switch.

13. The switch assembly according to claim 12 wherein a distance between said second upper contact and said second lower contact is less than a distance between a bottom of said actuator and a top of said dome switch when the switch assembly is in a neutral position.

14. The switch assembly according to claims 12 wherein said key cap comprises a rigid material.

15. The switch assembly according to claim 12 wherein said resilient protrusion may form an arch.

16. A camera device comprising a lens, a camera shutter, and a switch assembly for focusing an image entering said lens and activating said camera shutter, said switch assembly comprising:

a base;

a push key comprising a resilient form securable to an external housing to be in spaced relation above said base;

an inner switch comprising a first upper contact supported above a first lower contact and actuated by movement of said push key, said first lower contact being supported by said base; and, an outer switch surrounding at least a portion of said inner switch, said outer switch comprising a second upper contact supported above a second lower contact and actuated by said push key, said second lower contact being supported by said base;

wherein a first movement of said push key towards said base engages either said first contacts or said second contacts thereby focusing said image entering said lens, and a further movement of said push key towards said base engages the other of said first contacts or said second contacts through deformation of said resilient form thereby activating said camera shutter to capture said image.

17. The camera device according to claim 16 wherein said push key comprises a key cap.

18. The camera device according to claim 17 wherein said outer switch comprises resilient arches to support said second upper contact.

19. The camera device according to claim 18 wherein said resilient arches are supported by the key cap.

20. The camera device according to claim 18 wherein said resilient arches are supported by said base.

* * * * *